US008534364B2

(12) United States Patent
Underbakke

(10) Patent No.: US 8,534,364 B2
(45) Date of Patent: Sep. 17, 2013

(54) ASSEMBLY AND METHOD FOR PRODUCTION OF GAS OR GAS AND CONDENSATE/OIL

(75) Inventor: Harald Underbakke, Sandnes (NO)

(73) Assignee: Statoil ASA, Stavanger (NO)

( * ) Notice: Subject to any disclaimer, the term of this patent is extended or adjusted under 35 U.S.C. 154(b) by 498 days.

(21) Appl. No.: 12/811,919

(22) PCT Filed: Dec. 18, 2008

(86) PCT No.: PCT/NO2008/000461

§ 371 (c)(1),
(2), (4) Date: Sep. 23, 2010

(87) PCT Pub. No.: WO2009/088294

PCT Pub. Date: Jul. 16, 2009

(65) Prior Publication Data

US 2011/0024127 A1 Feb. 3, 2011

(30) Foreign Application Priority Data

Jan. 7, 2008 (NO) ..... 20080105

(51) Int. Cl.
*E21B 43/16* (2006.01)
*E21B 43/01* (2006.01)

(52) U.S. Cl.
USPC ..... 166/360; 166/344; 166/351; 166/268; 166/372; 166/90.1; 417/904; 60/398

(58) Field of Classification Search
USPC ..... 166/360, 344, 351, 368, 268, 263, 166/305.1, 306, 369, 372, 90.1; 417/904; 60/398
See application file for complete search history.

(56) References Cited

U.S. PATENT DOCUMENTS

| | | | | |
|---|---|---|---|---|
| 2,953,204 | A * | 9/1960 | Doscher et al. | 166/266 |
| 4,095,421 | A * | 6/1978 | Silcox | 60/398 |
| 4,238,331 | A * | 12/1980 | Mitchell et al. | 210/698 |
| 4,848,471 | A * | 7/1989 | Bencze | 166/335 |
| 5,117,908 | A * | 6/1992 | Hofmann | 166/267 |
| 5,813,469 | A * | 9/1998 | Bowlin | 166/369 |
| 6,336,503 | B1 * | 1/2002 | Alhanati et al. | 166/265 |
| 6,457,522 | B1 * | 10/2002 | Bangash et al. | 166/267 |
| 6,998,724 | B2 * | 2/2006 | Johansen et al. | 290/1 R |
| 7,152,681 | B2 * | 12/2006 | Olsen et al. | 166/357 |
| 7,152,682 | B2 * | 12/2006 | Hopper | 166/357 |
| 7,224,080 | B2 * | 5/2007 | Smedstad | 290/43 |
| 7,249,634 | B2 * | 7/2007 | de Albuquerque Lima Goncalves et al. | 166/335 |
| 7,594,543 | B2 * | 9/2009 | Goncalves et al. | 166/372 |
| 7,654,328 | B2 * | 2/2010 | Stinessen et al. | 166/356 |
| 7,686,086 | B2 * | 3/2010 | Brammer | 166/357 |
| 7,963,335 | B2 * | 6/2011 | Krehbiel et al. | 166/335 |

FOREIGN PATENT DOCUMENTS

| | | | |
|---|---|---|---|
| NO | 20043636 | A | 12/2007 |
| RU | 2109930 | C1 | 4/1998 |
| WO | 0233218 | A1 | 4/2002 |

* cited by examiner

*Primary Examiner* — Matthew Buck
(74) *Attorney, Agent, or Firm* — Volpe and Koenig, P.C.

(57) ABSTRACT

An underwater placed assembly produces gas or gas and oil/condensate from a subsea gaseous reservoir, where at least one production well is provided from the seabed to a production zone and at least one water injection well is provided from the seabed to an injection zone. The assembly includes: a pressure increasing device connected to the outlet of the production well in order to increase the pressure in a production flow from the production well, and a water turbine that is connected to and driving the pressure increasing device.

10 Claims, 2 Drawing Sheets

ASSEMBLY AND METHOD FOR PRODUCTION OF GAS OR GAS AND CONDENSATE/OIL

FIELD OF INVENTION

This invention relates to production of gas, or gas and condensate/oil, from a subsea, gaseous reservoir.

The invention further relates to an assembly and a method for production of gas, or gas and condensate/oil, from a subsea gaseous reservoir where the gas pressure is low.

BACKGROUND

In a gaseous reservoir the pressure may drop relatively fast, which results in diminishing production. After some time of production, the pressure in the gaseous reservoir may have dropped to a pressure that is lower than the pressure from the water at the seabed/sea bottom/water bottom above the reservoir. Thus it becomes feasible to inject water in the lower water containing parts of the reservoir without any injection pump or other pressure support, but only by arranging an injection well in which water can flow through due to high hydrostatic pressure at the seabed at the inlet of the injection well.

In order to support the production of gas flow from a gas reservoir, it is known to arrange a gas compressor at the outlet of the production well, either at the seabed or at the surface installation. Gas compressors are usually operated/driven electrically. For gaseous reservoirs with condensate/oil, multiple face machines or -pumps may alternatively be installed, which are typically electrically operated.

In the patent publication RU2109930, a method for developing gas reserves below the continental shelf is disclosed. The method aims to avoid use of the pressure increasing compressor station with compression of gas prior to further transport. Further the aim is to reduce the costs for developing the reservoir to a commercial level. At a predetermined moment the injection wells are put into operation in order to maintain the pressure with pumpless injection of seawater in the reservoir wells by utilizing the pressure of the water column between the sea surface and the well head level. Water injection without pumping utilizes the pressure head in the water column between the sea surface and the level of the well head at the seabed. The advantage according to the teaching in the mentioned publication is development of the field with reduced capital costs due to delivery of gas to the gas pipes without use of compressors, and maintaining the reservoir pressure without pumping. Possibility for installation of hydraulic turbines in the injection wells for production of electricity are mentioned.

In the patent publication WO 02/33218 A1 methods and arrangements for treatment of fluid are disclosed. Furthermore, methods and arrangements are disclosed to utilize the energy in water flowing from a high pressure reservoir. For gas production and gas/condensate/oil production from fields with low and diminishing pressure, there is a need for methods and assemblies which may deliver energy to the gas flow or the gas/condensate/oil flow to maintain the production as well as contribute to maintain the pressure in the reservoir during diminishing reservoir pressure. The objects of the present invention are to meet the above mentioned requirements.

SUMMARY

With the present invention an underwater placed assembly for production of gas, or gas and condensate/oil, from a subsea gaseous reservoir is provided, where at least one production well is arranged from the seabed to a production zone and at least one water injection well is arranged from the seabed to an injection zone. The assembly is characterized by comprising:

a pressure increasing device connected to the outlet of the production well to increase pressure in a production flow from the production well, and a water turbine connected to and operating the pressure increasing device, said water turbine has an inlet for water with a high hydrostatic pressure according to the location of the water turbine and an outlet connected to an inlet of the water injection well, the water turbines is driven by and withdraw at least a part of the hydrostatic energy from the water which then can be delivered with lower pressure to the water injection well, so that water thereby delivered to the water injection well will have a lower pressure than the hydrostatic pressure at the inlet of the water injection well.

The terms production well and water injection well must here be interpreted as not only two separate wells of the mentioned types but also separate fluid paths for production and water injection in one and the same well. In an advantageous embodiment of this invention the production well and the water injection well is one and the same well. For example, the fluid path for one of production and injection is in an annular space around an inner pipe, while the other fluid path of production and injection is in the inner pipe, alternatively two separate pipes are provided. Most preferred the production is provided in an annular space around an injection pipe extended down to the production zone with a sealing between the injection and production level in the well.

The pressure increasing device is provided instead of on top of or next to or to a wellhead, down in a well or in a well frame in a position normally meant for a wellhead.

For gas production the pressure increasing device is a gas compressor; for production of gas and condensate/oil the pressure increasing device is a multiple phase machine/pump. The water injection well may be attached to another reservoir than the production well. The pressure increasing device and the water turbine are preferably provided on a common shaft, which is preferred as regard to efficiency and cost. In an alternative embodiment the pressure increasing device and the water turbine are interconnected via a gear ratio, which is advantageous as regards to operation. In an advantageous embodiment the water turbine and the pressure increasing device are interconnected hydraulically, for example via a hydraulic loop, directly or indirectly driven by the water turbine, where the water turbine and the pressure increasing device can be arranged further apart, whereby operating benefits may be achieved. Thus the water turbine may be provided at lower level than the pressure increasing device, and the water turbine may more easily be attached to a water injection well in another reservoir. The pressure increasing device and the water turbine are typically located on the seabed at the outlet from the production well. In an advantageous embodiment of this invention, particularly relevant for shallow sea depths, the pressure increasing device and the water turbine are provided in a recess in the seabed at the outlet from the production well, which advantageously increases the pressure head for the water turbine and thus the efficiency.

With the present invention a method for production of gas or gas and condensate/oil from a subsea, gaseous reservoir is also provided, at least one production well being provided from the seabed to a production zone and at least one water injection well is provided from the seabed to an injection zone, by utilizing the assembly according to this invention. The method is characterized by comprising:

increasing the pressure in a production flow from the production well by means of a pressure increasing device attached to the outlet from the production well, and injecting water through the injection well to the injection zone in order to maintain the pressure in the reservoir, where a water turbine is connected to the inlet of the water injection well, which water turbine is connected to and operate the pressure increasing device, the water turbine having an inlet for water with high hydrostatic pressure according to the location of the water turbine and an outlet connected to the inlet of the water injection well, the water turbine is operated by and withdrawing at least part of the hydrostatic energy from the water, which thus is delivered with a lower pressure to the water injection well, so that water thus delivered to the water injection well has a lower pressure than the hydrostatic pressure at the inlet of the water injection well.

Operating the water turbine and withdrawing at least a part of the hydrostatic energy from the water which thus is delivered at a lower pressure to the water injection well, the entire pressure head at the location of the water turbine advantageously is withdrawn, so that the pressure in water delivered from the water turbine to the water injection well will equal about 1 atmosphere. The entire pressure head, less loss, will thus be used for the pressure increase in the pressure increasing device, while water is flowing into the injection zone through the water injection well by means of the pressure head or the drop head from the inlet of the water injection well to the injection zone in the reservoir. Such a practice of the invention is possible as soon as the pressure in the injection zone is lower than the pressure head or the drop head from the inlet of the water injection well to the injection zone, corrected for pressure loss in well and injection zone. However, the pressure in a gas reservoir or in a gaseous reservoir will drop gradually, and the invention is applicable and is substantially different from prior art as long as at least part of the hydrostatic energy can be used as intended. Particularly the pressure in the injection zone must be lower than the delivered pressure from the water turbine plus the pressure/drop head in the water injection well, corrected for pressure loss.

The water turbine having an inlet for water with a high hydrostatic pressure related to the location of the water turbine, entitles that the inlet introduce water with a pressure equal to or mainly equal to the hydrostatic water pressure where the water turbine is located, that is on the seabed, in a recess in the seabed or on a subsea installation. In the inlet a filter is preferably arranged to prevent plugging of the injection well, and the inlet does not need to be in the form of a line extending the distance from the water turbine.

BRIEF DESCRIPTION OF THE DRAWINGS

The present invention is illustrated by means of two figures of which.

DETAILED DESCRIPTION OF THE PREFERRED EMBODIMENT(S)

Figure 1:
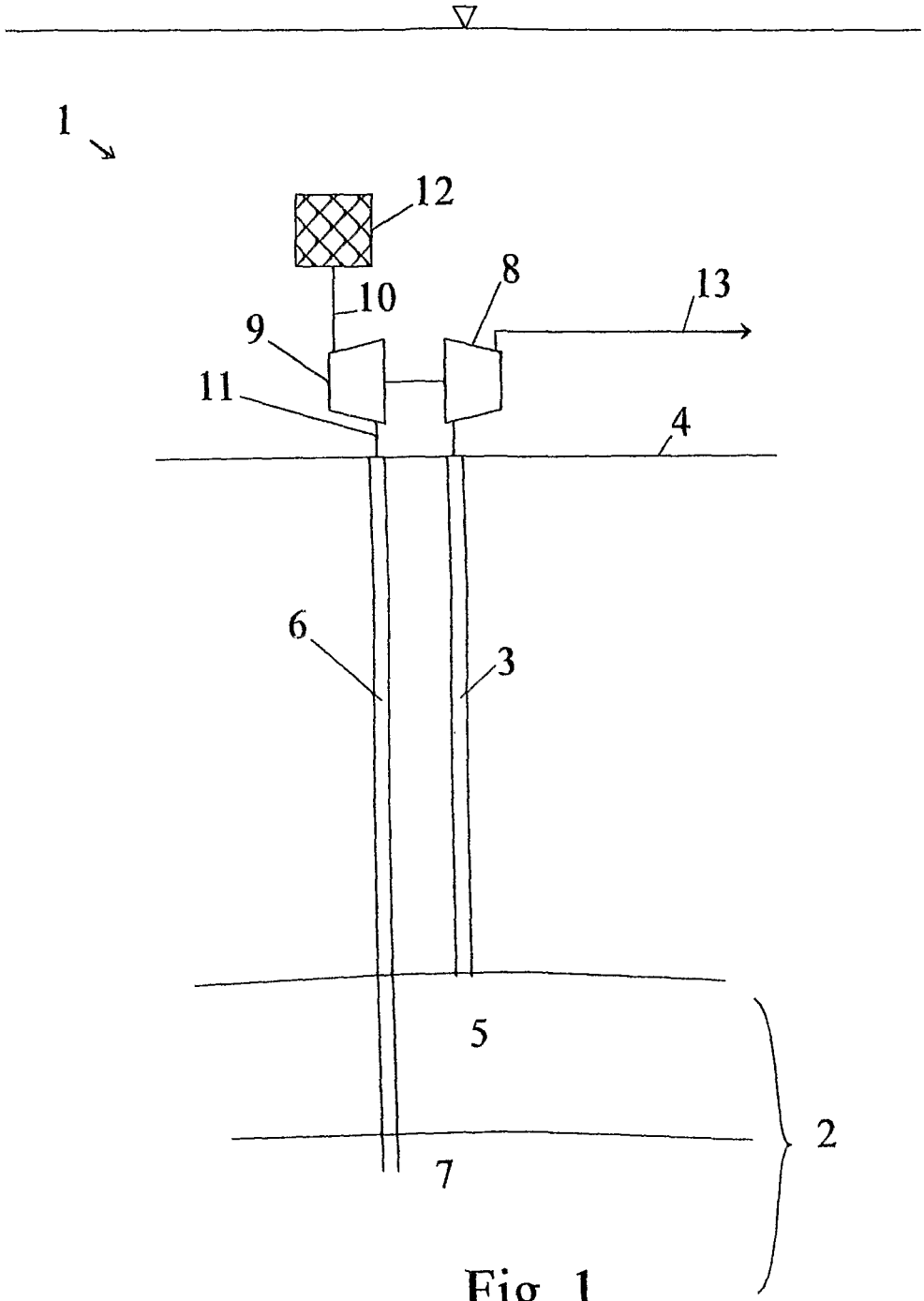
FIG. 1 illustrates an assembly according to the invention.

Reference is made to FIG. 1, which illustrates an underwater arranged assembly 1 according to the invention for production of gas, or gas and condensate, from a subsea reservoir 2, at least one production well 3 being provided from the seabed 4 to a production zone 5 and at least one water injection well 6 is provided from the seabed 4 to an injection zone 7. The assembly 1 comprises a pressure increasing device 8 in the form of a compressor attached to the outlet from the production well, and a water turbine 9 attached to and driving the compressor. The compressor 8 and water turbine 9 are both located on the seabed, and the units are interconnected by means of common shaft. The water turbine 9 has an inlet 10 and an outlet 11 connected to the inlet of the water injection well. On the inlet 10 to the water turbine, a filter 12 is provided. The water turbine is driven by and withdraws at least a part of the hydrostatic energy from the water flowing through the water turbine, where water with a lower pressure is delivered to the water injection well so that water thus delivered to the water injection well will have a lower pressure than the hydrostatic pressure at the inlet of the water injection well. A pipeline 13 is attached to the compressor 8 for further transport of compressed gas.

Figure 2:
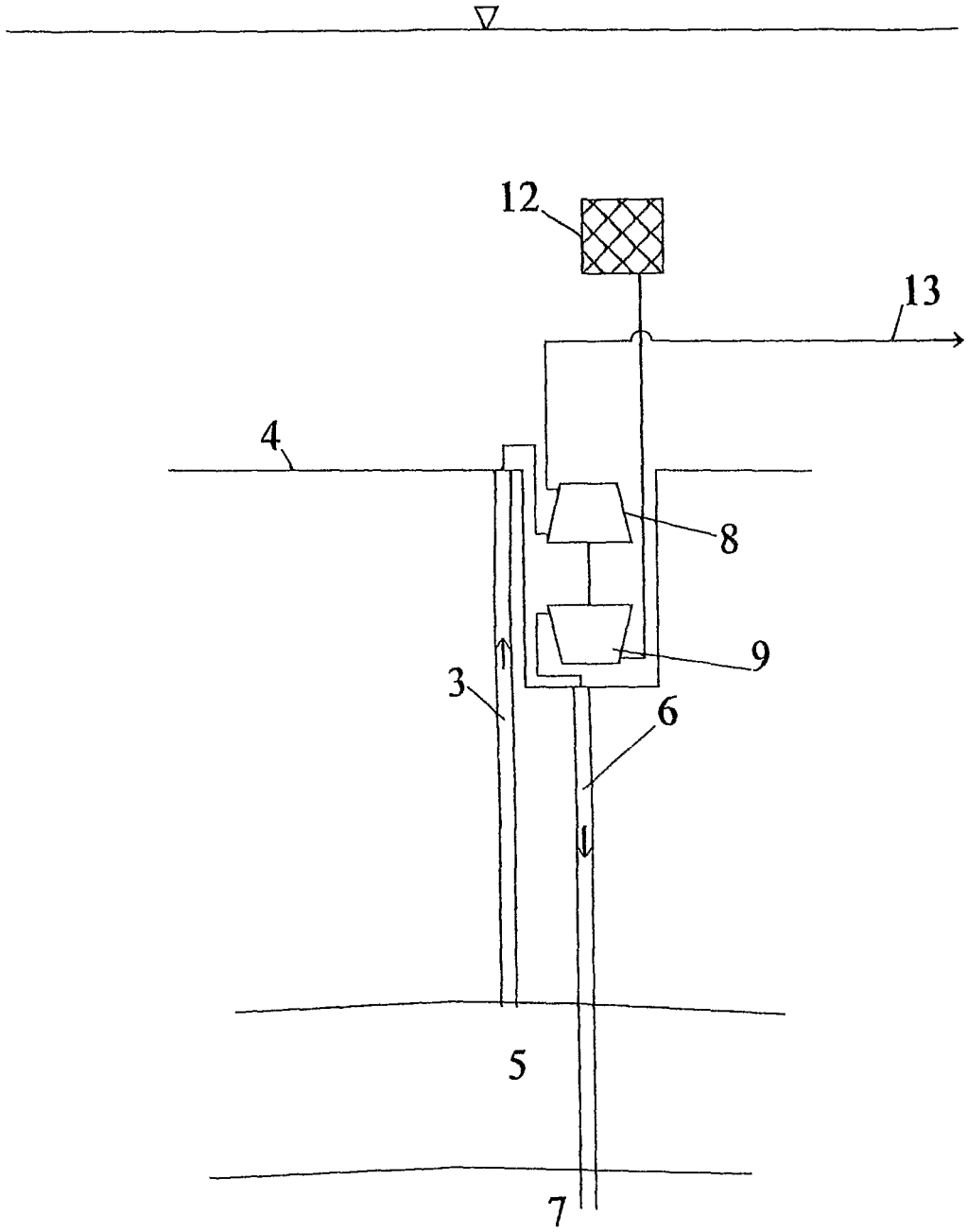
FIG. 2 illustrates an alternative assembly according to the invention.

Further reference is made to FIG. 2 illustrating an alternative underwater located assembly 1 according to the invention. The alternative assembly is different from the assembly shown in FIG. 1 by that the compressor 8 and the water turbine 9 are located in a recess on the seabed and the arrangement of the mentioned devices and the connection between them are vertical, where the water turbine is arranged at the bottom.

By using a pressure increasing device which directly, via a gear ratio or hydraulically, is driven by the water turbine, problems with electric isolation resistance < and degrading of this are avoided, which is a big problem for electrically. driven pressure increasing devices.

Preferably the water turbine and the pressure increasing device is mounted on a common shaft and designed so that the drive speed is below the first bending critical oscillation mode of the shaft.

In that the outlet of the water turbine is connected to the water injection well problems with mechanically rotating shaft sealing against, sea and any spill of hydrocarbons are thus avoided. The inlet pressure to the water injection well equals the outlet pressure from the water turbine and is lower than the surrounding hydrostatic pressure.

Preferably both the water turbine and the pressure increasing device are designed with product lubricated bearings, that is, water and gas/condensate/$oil_5$ respectively, which simplifies the design. Alternatively the assembly comprises oil lubricated bearings or glycol lubricated bearings, which is advantageous when the water pressure into the turbine is lower than the pressure in the production flow into the compressor or a multiphase machine. In the embodiment with alternative bearings combined lubrication and blocking fluid could be necessary between the turbine and the compressor/multiphase machine, such as shown in the patent application NO 2004 3636.

Preferably valves, connections and telemetry are provided in order to control the injection rate and efficiency of the pressure increasing device. For example a valve may be provided at the outlet from the water turbine or in the injection well.

Furthermore, shutdown valve or check valve may be provided in the inlet to the injection well, possibly down in the injection well, in order to prevent discharge from the injection well should the pressure in the injection zone not yet be sufficiently low in order to practice the invention. Alternatively a pump may be provided in order to fill the water injection well with water before start up, which is advantageous should the pressure in the injection zone be almost equal to the pressure at the seabed, or if shut down over longer period of time period may entail a risk that the water injection well is filled with gas flowing in from the production zone. In an embodiment the assembly according to the invention comprises an inlet to the water injection well external to the water turbine, alternatively provided with a pump, which pump, if any, may fill the injection well with water in addition to work as an injection pump, in order to start the water injection at an earlier stage, that is before the pressure in the injection zone has dropped sufficiently that part of the hydrostatic energy may be withdrawn with the water turbine in order to drive the pressure increasing device.

This invention comprises also an embodiment with a separator provided with attachment to the production well, with downstream provided pump and compressor both driven by the water turbine.

The water injection is practiced preferably according to normal practice, that is that produced volume is replaced in order to maintain the reservoir pressure, while water break through to the producing wells or inadvertent blocking of the reservoir zones is avoided.

The invention claimed is:

1. An underwater placed assembly for production of gas, or gas and condensate/oil, from subsea, gaseous reservoir, wherein at least one production well is provided from the seabed to a production zone and at least one water injection well is provided from the seabed to an injection zone, wherein the assembly comprises:

a pressure increasing device connected to the outlet from the production well in order to increase the pressure in a production flow from the production well, and a water turbine connected to and driving the pressure increasing device, said water turbine has an inlet for water, which is directly drawn from a location in the sea adjacent to the water turbine and said water has a high hydrostatic pressure caused by the pressure of the water column between the sea surface and the well level, and an outlet connected to the inlet of the water injection well, the water turbine driven by and withdrawing at least a part of the hydrostatic energy from the water thus delivered with a lower pressure to the water injection well, so that water thus delivered to the water injection well has a lower pressure than the hydrostatic pressure at the inlet of the water turbine.

2. The assembly according to claim 1, wherein the production well and the water injection well are fluid paths in one and the same well.

3. The assembly according to claim 2, wherein the fluid path for production is an annular space around an inner pipe, while the fluid path for injection is in the inner pipe.

4. The assembly according to claim 1, wherein the pressure increasing device is provided on top of a wellhead.

5. The assembly according to claim 1, wherein the pressure increasing device is a gas compressor.

6. The assembly according to claim 1, wherein the pressure increasing device is a multiphase machine/pump.

7. The assembly according to claim 1, wherein the pressure increasing device and the water turbine are provided on a common shaft.

8. The assembly according to claim 1, wherein the pressure increasing device and the water turbine are placed on the seabed at the outlet from the production well.

9. The assembly according to claim 1, wherein the pressure increasing device and the water turbine are provided in a recess in the seabed at the outlet from the production well.

10. A method for production of gas, or gas and condensate/oil, from a subsea gaseous reservoir, where at least one production well is provided from the seabed to the production zone, and at least one water injection well is provided from the seabed to an injection zone, utilizing the assembly according to claim 1, wherein the method comprises:

increasing the pressure in a production flow from the production well by means of a pressure increasing device connected to the outlet from the production well, and injecting water through the injection well to the injection zone in order to maintain the pressure in the reservoir, whereby a water turbine is connected to the inlet of the water injection well, said water turbine is connected to and driving the pressure increasing device, the water turbine has an inlet for water, which is directly drawn from a location in the sea adjacent to the water turbine and said water has a high hydrostatic pressure caused by the pressure of the water column between the sea surface and the well level, and an outlet connected to the inlet of the water injection well, the water turbine is driven by, and withdrawing at least part, of the hydrostatic energy from the water thus delivered with a lower pressure to the water injection well, so that the water thus delivered to the water injection well has a lower pressure than the hydrostatic pressure at the inlet of the water turbine.

* * * * *